US010524075B2

(12) United States Patent
Maeno et al.

(10) Patent No.: US 10,524,075 B2
(45) Date of Patent: Dec. 31, 2019

(54) SOUND PROCESSING APPARATUS, METHOD, AND PROGRAM

(71) Applicant: Sony Corporation, Tokyo (JP)

(72) Inventors: Yu Maeno, Tokyo (JP); Yuhki Mitsufuji, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/779,967

(22) PCT Filed: Nov. 29, 2016

(86) PCT No.: PCT/JP2016/085284
§ 371 (c)(1),
(2) Date: May 30, 2018

(87) PCT Pub. No.: WO2017/098949
PCT Pub. Date: Jun. 15, 2017

(65) Prior Publication Data

US 2018/0359594 A1 Dec. 13, 2018

(30) Foreign Application Priority Data

Dec. 10, 2015 (JP) ..... 2015-241138

(51) Int. Cl.
*H04S 7/00* (2006.01)
*H04R 1/40* (2006.01)
(Continued)

(52) U.S. Cl.
CPC ..... *H04S 7/303* (2013.01); *H04R 1/40* (2013.01); *H04R 3/00* (2013.01); *H04R 5/02* (2013.01);
(Continued)

(58) Field of Classification Search
CPC . H04S 7/00; H04S 7/303; H04S 3/008; H04S 2400/01; H04S 2400/11;
(Continued)

(56) References Cited

U.S. PATENT DOCUMENTS 5,142,586 A 8/1992 Berkhout
9,380,398 B2 6/2016 Mitsufuji
(Continued)

FOREIGN PATENT DOCUMENTS

EP 2 540 094 A1 1/2013
EP 3 073 766 A1 9/2016
(Continued)

OTHER PUBLICATIONS

International Search Report and English translation thereof dated Feb. 21, 2017 in connection with International Application No. PCT/JP2016/085284.
(Continued)

*Primary Examiner* — William A Jerez Lora
(74) *Attorney, Agent, or Firm* — Wolf, Greenfield & Sacks, P.C.

(57) ABSTRACT

The present technology relates to a sound processing apparatus, a method, and a program that can reproduce an acoustic field more appropriately.
A sound source position correction unit corrects sound source position information indicating a position of each object sound source, on the basis of a hearing position of a sound, and derives corrected sound source position information. A reproduction area control unit calculates, on a basis of an object sound source signal of a sound of an object sound source, the hearing position, and corrected sound source position information obtained by the correction, a spatial frequency spectrum such that a reproduction area is adjusted in accordance with the hearing position provided
(Continued)

inside a spherical or annular speaker array. The present technology can be applied to a sound processing apparatus.

10 Claims, 8 Drawing Sheets

(51) Int. Cl.
*H04R 3/00* (2006.01)
*H04R 5/02* (2006.01)
*H04S 3/00* (2006.01)

(52) U.S. Cl.
CPC ..... *H04S 3/008* (2013.01); *H04S 7/00* (2013.01); *H04R 2201/401* (2013.01); *H04S 2400/01* (2013.01); *H04S 2400/11* (2013.01); *H04S 2420/11* (2013.01)

(58) Field of Classification Search
CPC ..... H04S 2420/11; H04R 1/40; H04R 3/00; H04R 5/02; H04R 2201/401
USPC ..... 381/1, 2, 56, 89, 124, 303
See application file for complete search history.

(56) References Cited

U.S. PATENT DOCUMENTS

| | | | | |
|---|---|---|---|---|
| 9,445,174 | B2 | 9/2016 | Virolainen | |
| 10,015,615 | B2 | 7/2018 | Mitsufuji et al. | |
| 10,380,991 | B2 | 8/2019 | Maeno et al. | |
| 2005/0259832 | A1 | 11/2005 | Nakano | |
| 2009/0028345 | A1 | 1/2009 | Jung et al. | |
| 2011/0194700 | A1 | 8/2011 | Hetherington et al. | |
| 2013/0128701 | A1 | 5/2013 | Derkx | |
| 2014/0321653 | A1 | 10/2014 | Mitsufuji | |
| 2015/0170629 | A1 | 6/2015 | Christoph | |
| 2016/0080886 | A1* | 3/2016 | De Bruijn | H04S 7/302 381/17 |
| 2016/0163303 | A1 | 6/2016 | Benattar et al. | |
| 2016/0180861 | A1 | 6/2016 | Masuda | |
| 2016/0198280 | A1* | 7/2016 | Schneider | H04S 7/40 381/17 |
| 2016/0269848 | A1* | 9/2016 | Mitsufuji | H04S 7/30 |
| 2016/0337777 | A1* | 11/2016 | Tsuji | H04S 3/008 |
| 2017/0034620 | A1 | 2/2017 | Mitsufuji | |
| 2018/0075837 | A1 | 3/2018 | Maeno et al. | |
| 2018/0249244 | A1 | 8/2018 | Maeno et al. | |
| 2018/0279042 | A1 | 9/2018 | Mitsufuji | |
| 2019/0198036 | A1 | 6/2019 | Osako et al. | |

FOREIGN PATENT DOCUMENTS

| | | | |
|---|---|---|---|
| JP | 2-503721 | A | 11/1990 |
| JP | 5-284591 | A | 10/1993 |
| JP | 2005-333211 | A | 12/2005 |
| JP | 2010-062700 | A | 3/2010 |
| JP | 2010-193323 | A | 9/2010 |
| JP | 2013-520858 | A | 6/2013 |
| JP | 2014-090293 | A | 5/2014 |
| JP | 2015-027046 | A | 2/2015 |
| JP | 2015-095802 | A | 5/2015 |
| WO | WO 89/09465 | A1 | 10/1989 |
| WO | WO 2011/104655 | A1 | 9/2011 |
| WO | WO 2015/076149 | A1 | 5/2015 |
| WO | WO 2015/097831 | A1 | 7/2015 |

OTHER PUBLICATIONS

Written Opinion and English translation thereof dated Feb. 21, 2017 in connection with International Application No. PCT/JP2016/085284.
International Preliminary Report on Patentability and English translation thereof dated Jun. 21, 2018 in connection with International Application No. PCT/JP2016/085284.
Ahrens et al., An Analytical Approach to Sound Field Reproduction with a Movable Sweet Spot using Circular Distributions of Loudspeakers, Proceedings of the IEEE International Conference on Acoustics, Speech, and Signal Processing, ICASSP, 2009, pp. 273-276.
International Search Report and English translation thereof dated Nov. 15, 2016 in connection with International Application No. PCT/JP2016/074453.
International Written Opinion and English translation thereof dated Nov. 15, 2016 in connection with International Application No. PCT/JP2016/074453.
International Preliminary Report on Patentability and English translation thereof dated Mar. 15, 2018 in connection with International Application No. PCT/JP2016/074453.
International Search Report and Written Opinion and English translation thereof dated May 10, 2016 in connection with International Application No. PCT/JP2016/060895.
International Preliminary Report on Patentability and English translation thereof dated Oct. 26, 2017 in connection with International Application No. PCT/JP2016/060895.
U.S. Appl. No. 14/249,780, filed Apr. 10, 2014, Mitsufuji.
U.S. Appl. No. 15/034,170, filed May 3, 2016, Mitsufuji et al.
U.S. Appl. No. 15/302,468, filed Oct. 6, 2016, Mitsufuji.
U.S. Appl. No. 15/516,563, filed Apr. 3, 2017, Mitsufuji.
U.S. Appl. No. 15/564,518, filed Oct. 5, 2017, Maeno et al.
U.S. Appl. No. 15/754,795, filed Feb. 23, 2018, Maeno et al.
U.S. Appl. No. 16/326,956, filed Feb. 21, 2019, Osako et al.
Ahrens et al., Applying the Ambisonics Approach on Planar and Linear Arrays of Loudspeakers, Proc. of the 2nd International Symposium on Ambisonics and Spherical Acoustics, May 6-7, 2010, Paris, France, 6 pages.
Ando A., Research Trend of Acoustic System based on Physical Acoustic Model [Butsuri Onkyo Model ni Motozuku Onkyo System no Kenkyu Kogo], NHK Science and Technical Research Laboratories R&D Report, No. 126, Mar. 2011, 35 pages.
Kamado et al., Sound Field Reproduction by Wavefront Synthesis Using Directly Aligned Multi Point Control, AES 40$^{th}$ International Conference, Tokyo, Japan, Oct. 8-10, 2010, 9 pages.

* cited by examiner

SOUND PROCESSING APPARATUS, METHOD, AND PROGRAM

TECHNICAL FIELD

The present technology relates to a sound processing apparatus, a method, and a program, and relates particularly to a sound processing apparatus, a method, and a program that can reproduce an acoustic field more appropriately.

BACKGROUND ART

For example, when an omnidirectional acoustic field is replayed by a Higher Order Ambisonics (HOA) using an annular or spheral speaker array, an area (hereinafter, referred to as a reproduction area) in which a desired acoustic field is correctly-reproduced is limited to the vicinity of the center of the speaker array. Thus, the number of people that can simultaneously hear a correctly-reproduced acoustic field is limited to a small number.

In addition, in a case where omnidirectional content is replayed, a listener is considered to enjoy the content while rotating his or her head. Nevertheless, in such a case, when a reproduction area has a size similar to that of a human head, a head of a listener may go out of the reproduction area, and expected experience may fail to be obtained.

Furthermore, if a listener can hear a sound of the content while performing translation (movement) in addition to the rotation of the head, the listener can sense feeling of localization of a sound image more, and can experience a realistic acoustic field. Nevertheless, also in such a case, when a head portion position of the listener deviates from the vicinity of the center of the speaker array, realistic feeling may be impaired.

In view of the foregoing, there is proposed a technology of moving a reproduction area of an acoustic field in accordance with a position of a listener, on the inside of an annular or spheral speaker array (for example, refer to Non-Patent Literature 1). If the reproduction area is moved in accordance with the movement of a head portion of the listener using this technology, the listener can always experience a correctly-reproduced acoustic field.

CITATION LIST

Non-Patent Literature

Non-Patent Literature 1: Jens Ahrens, Sascha Spors, "An Analytical Approach to Sound Field Reproduction with a Movable Sweet Spot Using Circular Distributions of Loudspeakers," ICASSP, 2009.

DISCLOSURE OF INVENTION

Technical Problem

Nevertheless, in the above-described technology, along with the movement of the reproduction area, the entire acoustic field follows the movement. Thus, when the listener moves, a sound image also moves.

In this case, when a sound to be replayed is a planar wave delivered from afar, for example, an arrival direction of a wave surface does not change even if the entire acoustic field moves. Thus, major influence on acoustic field reproduction is not generated. Nevertheless, in a case where a sound to be replayed is a spherical wave from a sound source relatively-close to the listener, the spherical wave sounds as if the sound source followed the listener.

In this manner, also in the case of moving a reproduction area, when a sound source is close to a listener, it has been difficult to appropriately reproduce an acoustic field.

The present technology has been devised in view of such a situation, and enables more appropriate reproduction of an acoustic field.

Solution to Problem

According to an aspect of the present technology, a sound processing apparatus includes: a sound source position correction unit configured to correct sound source position information indicating a position of an object sound source, on a basis of a hearing position of a sound; and a reproduction area control unit configured to calculate a spatial frequency spectrum on a basis of an object sound source signal of a sound of the object sound source, the hearing position, and corrected sound source position information obtained by the correction, such that a reproduction area is adjusted in accordance with the hearing position provided inside a spherical or annular speaker array.

The reproduction area control unit may calculate the spatial frequency spectrum on a basis of the object sound source signal, a signal of a sound of a sound source that is different from the object sound source, the hearing position, and the corrected sound source position information.

The sound processing apparatus may further includes a sound source separation unit configured to separate a signal of a sound into the object sound source signal and a signal of a sound of a sound source that is different from the object sound source, by performing sound source separation.

The object sound source signal may be a temporal signal or a spatial frequency spectrum of a sound.

The sound source position correction unit may perform the correction such that a position of the object sound source moves by an amount corresponding to a movement amount of the hearing position.

The reproduction area control unit may calculate the spatial frequency spectrum in which the reproduction area is moved by the movement amount of the hearing position.

The reproduction area control unit may calculate the spatial frequency spectrum by moving the reproduction area on a spherical coordinate system.

The sound processing apparatus according to may further include: a spatial frequency synthesis unit configured to calculate a temporal frequency spectrum by performing spatial frequency synthesis on the spatial frequency spectrum calculated by the reproduction area control unit; and a temporal frequency synthesis unit configured to calculate a drive signal of the speaker array by performing temporal frequency synthesis on the temporal frequency spectrum.

According to an aspect of the present technology, a sound processing method or a program includes steps of: correcting sound source position information indicating a position of an object sound source, on a basis of a hearing position of a sound; and calculating a spatial frequency spectrum on a basis of an object sound source signal of a sound of the object sound source, the hearing position, and corrected sound source position information obtained by the correction, such that a reproduction area is adjusted in accordance with the hearing position provided inside a spherical or annular speaker array.

According to an aspect of the present technology, sound source position information indicating a position of an object sound source is corrected on a basis of a hearing position of a sound, and a spatial frequency spectrum is calculated on a basis of an object sound source signal of a sound of the object sound source, the hearing position, and corrected sound source position information obtained by the correction, such that a reproduction area is adjusted in accordance with the hearing position provided inside a spherical or annular speaker array.

Advantageous Effects of Invention

According to an aspect of the present technology, an acoustic field can be reproduced more appropriately.

Further, the effects described herein are not necessarily limited, and any effect described in the present disclosure may be included.

MODE(S) FOR CARRYING OUT THE INVENTION

Hereinafter, embodiments to which the present technology is applied will be described with reference to the accompanying drawings.

First Embodiment

<About Present Technology>

The present technology enables more appropriate reproduction of an acoustic field by fixing a position of an object sound source within a space irrespective of a movement of a listener while causing a reproduction area to follow a position of the listener, using position information of the listener and position information of the object sound source at the time of acoustic field reproduction.

Figure 1:
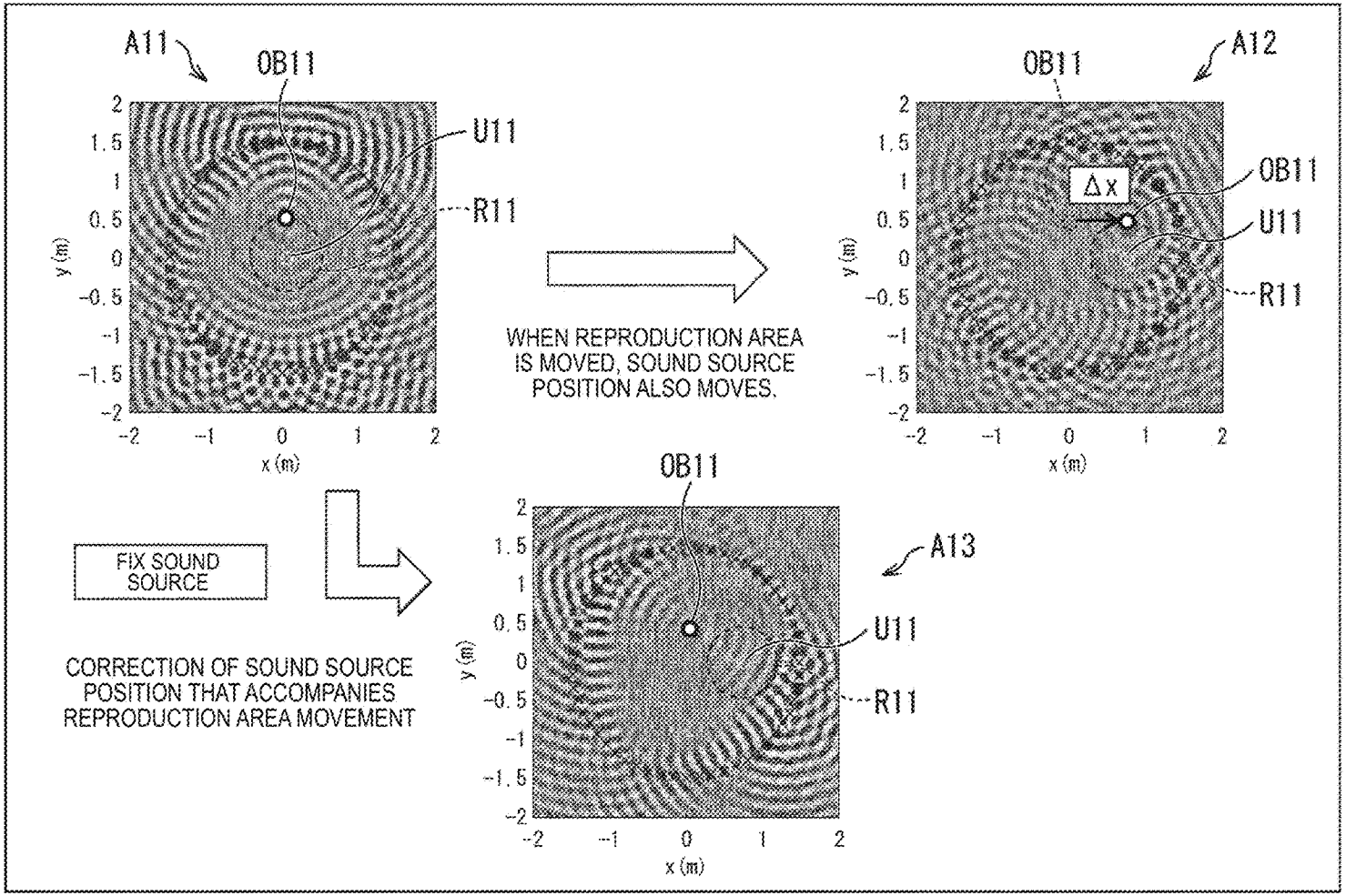
FIG. 1 is a diagram for describing the present technology.

For example, a case in which an acoustic field is reproduced in a replay space as indicated by an arrow A11 in FIG. 1 will be considered. Note that contrasting density in the replay space in FIG. 1 represents sound pressure of a sound replayed by a speaker array. In addition, a cross mark ("x" mark) in the replay space represents each speaker included in the speaker array.

In the example indicated by the arrow A11, a region in which an acoustic field is correctly-reproduced, that is to say, a reproduction area R11 referred to as a so-called sweet spot is positioned in the vicinity of the center of the annular speaker array. In addition, a listener U11 who hears the reproduced acoustic field, that is to say, the sound replayed by the speaker array exists at an almost center position of the reproduction area R11.

The listener U11 is assumed to feel that the listener U11 hears a sound from a sound source OB11, when an acoustic field is reproduced by the speaker array at the present moment. In this example, the sound source OB11 is at a position relatively-close to the listener U11, and a sound image is localized at the position of the sound source OB11.

When such acoustic field reproduction is being performed, for example, the listener U11 is assumed to perform rightward translation (move toward the right in the drawing) in the replay space. In addition, at this time, the reproduction area R11 is assumed to be moved on the basis of a technology of moving a reproduction area, in accordance with the movement of the listener U11.

Accordingly, for example, the reproduction area R11 also moves in accordance with the movement of the listener U11 as indicated by an arrow A12, and it becomes possible for the listener U11 to hear a sound within the reproduction area R11 even after the movement.

Nevertheless, in this case, the position of the sound source OB11 also moves together with the reproduction area R11, and relative positional relationship between the listener U11 and the sound source OB11 that is obtained after the movement remains the same as that obtained before the movement. The listener U11 therefore feels strange because the position of the sound source OB11 viewed from the listener U11 does not move even though the listener U11 moves.

In view of the foregoing, in the present technology, more appropriate acoustic field reproduction is made feasible by moving the reproduction area R11 in accordance with the movement of the listener U11, on the basis of the technology of moving a reproduction area, and also performing the correction of the position of the sound source OB11 appropriately at the time of the movement of the reproduction area R11.

This not only enables the listener U11 to hear a correctly-reproduced acoustic field (sound) within the reproduction area R11 even after the movement, but also enables the position of the sound source OB11 to be fixed in the replay space, as indicated by an arrow A13, for example.

In this case, because the position of the sound source OB11 in the replay space remains the same even if the listener U11 moves, more realistic acoustic field reproduction can be provided to the listener U11. In other words, acoustic field reproduction in which the position of the sound source OB11 remains fixed while the reproduction area R11 is being caused to follow the movement of the listener U11 can be realized.

Here, the correction of the position of the sound source OB11 at the time of the movement of the reproduction area R11 can be performed by using listener position information indicating the position of the listener U11, and sound source position information indicating the position of the sound source OB11, that is to say, the position of the object sound source.

Note that the acquisition of the listener position information can be realized by attaching a sensor such as an acceleration sensor, for example, to the listener U11 using a method of some sort, or detecting the position of the listener U11 by performing image processing using a camera.

In addition, a conceivable acquisition method of the sound source position information of the sound source OB11, that is to say, the object sound source varies depending on what sound is to be replayed.

For example, in the case of object sound replay, sound source position information of an object sound source that is granted as metadata can be acquired and used.

In contrast to this, in the case of reproducing an acoustic field obtained by recording a wave surface using a microphone array, for example, the sound source position information can be obtained using a technology of separating object sound sources.

Note that the technology of separating object sound sources is described in detail in "Shoichi Koyama, Naoki Murata, Hiroshi Saruwatari, "Group sparse signal representation and decomposition algorithm for super-resolution in sound field recording and reproduction", in technical papers of the spring meeting of Acoustical Society of Japan, 2015 (hereinafter, referred to as Reference Literature 1)", and the like, for example.

In addition, it is considered to reproduce an acoustic field using headphones instead of the speaker array.

For example, a head-related transfer function (HRTF) from an object sound source to a listener can be used as a general technology. In this case, acoustic field reproduction can be performed by switching the HRTF in accordance with relative positions of the object sound source and the listener. Nevertheless, when the number of object sound sources increases, a calculation amount accordingly increases by an amount corresponding to the increase in number.

In view of the foregoing, in the present technology, in the case of reproducing an acoustic field using headphones, speakers included in a speaker array are regarded as virtual speakers, and HRTFS corresponding to these virtual speakers are convolved to drive signals of the respective virtual speakers. This can reproduce an acoustic field similar to that replayed using a speaker array. In addition, the number of convolution calculations of HRTF can be set to a definite number irrespective of the number of object sound sources.

Furthermore, in the present technology as described above, if the correction of a sound source position is performed while regarding a sound source that is close to a listener and requires the correction of a sound source position, as an object sound source, and the correction of a sound source position is not performed while regarding a sound source that is far from the listener and does not require the correction of a sound source position, as an ambient sound source, a calculation amount can be further reduced.

Here, a sound of the object sound source can be referred to as a main sound included in content, and a sound of the ambient sound source can be referred to as an ambient sound such as an environmental sound that is included in content. Hereinafter, a sound signal of the object sound source will be also referred to as an object sound source signal, and a sound signal of the ambient sound source will be also referred to as an ambient signal.

Note that, according to the present technology, also in the case of convoluting the HRTF into a sound signal of each sound source and reproducing an acoustic field using headphones, a calculation amount can be reduced even when the HRTF is convoluted only for the object sound source, and the HRTF is not convoluted for the ambient sound source.

According to the present technology as described above, because a reproduction area can be moved in accordance with a motion of a listener, a correctly-reproduced acoustic field can be presented to the listener irrespective of a position of the listener. In addition, even if the listener performs a translational motion, a position of an object sound source in a space does not change. The feeling of localization of a sound source can be therefore enhanced.

<Configuration Example of Acoustic Field Controller>

Next, a specific embodiment to which the present technology is applied will be described as an example in which the present technology is applied to an acoustic field controller.

Figure 2:
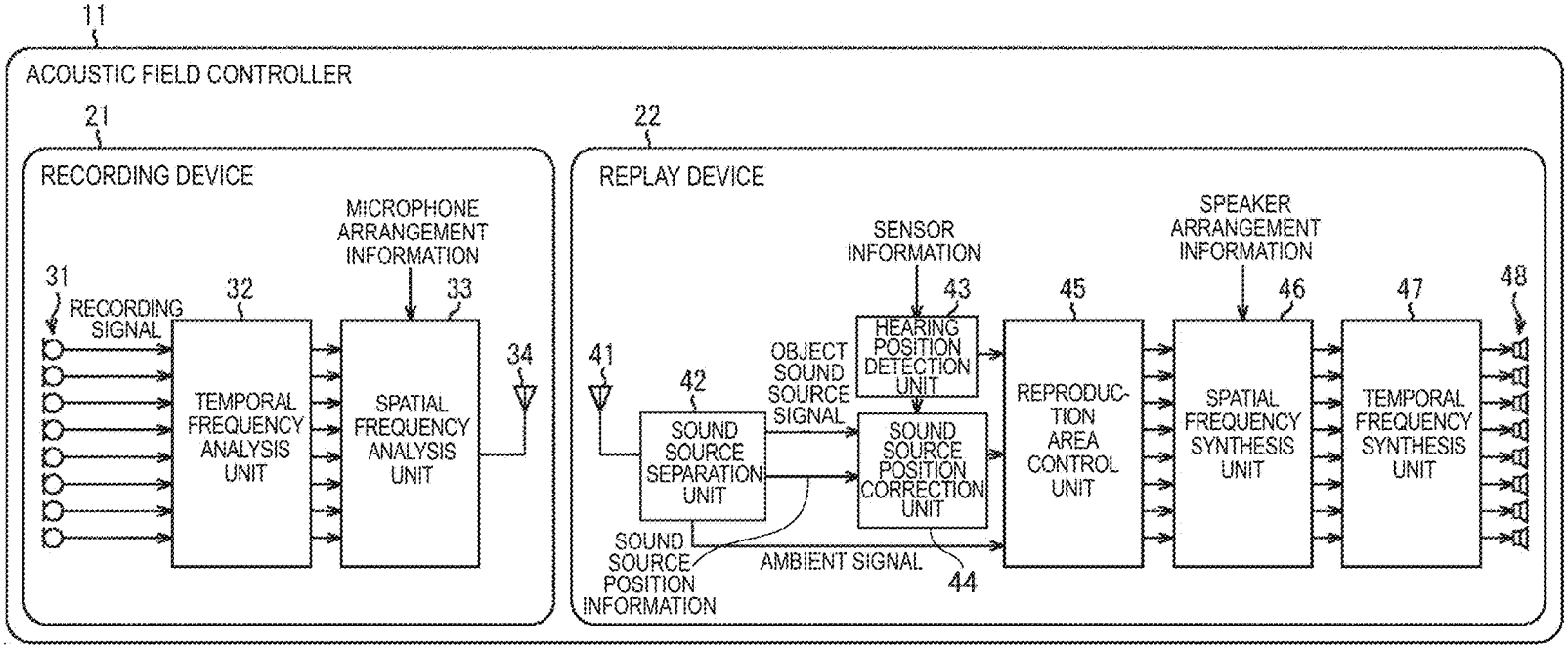
FIG. 2 is a diagram illustrating a configuration example of an acoustic field controller.

FIG. 2 is a diagram illustrating a configuration example of an acoustic field controller to which the present technology is applied.

An acoustic field controller 11 illustrated in FIG. 2 includes a recording device 21 arranged in a recording space, and a replay device 22 arranged in a replay space.

The recording device 21 records an acoustic field of the recording space, and supplies a signal obtained as a result of the recording, to the replay device 22. The replay device 22 receives the supply of the signal from the recording device 21, and reproduces the acoustic field of the recording space on the basis of the signal.

The recording device 21 includes a microphone array 31, a temporal frequency analysis unit 32, a spatial frequency analysis unit 33, and a communication unit 34.

The microphone array 31 includes, for example, an annular microphone array or a spherical microphone array, records a sound (acoustic field) of the recording space as content, and supplies a recording signal being a multichannel sound signal that has been obtained as a result of the recording, to the temporal frequency analysis unit 32.

The temporal frequency analysis unit 32 performs temporal frequency transform on the recording signal supplied from the microphone array 31, and supplies a temporal frequency spectrum obtained as a result of the temporal frequency transform, to the spatial frequency analysis unit 33.

The spatial frequency analysis unit 33 performs spatial frequency transform on the temporal frequency spectrum supplied from the temporal frequency analysis unit 32, using microphone arrangement information supplied from the outside, and supplies a spatial frequency spectrum obtained as a result of the spatial frequency transform, to the communication unit 34.

Here, the microphone arrangement information is angle information indicating a direction of the recording device 21, that is to say, the microphone array 31. The microphone arrangement information is information indicating a direction of the microphone array 31 that is oriented at a predetermined time such as a time point at which recording of an acoustic field, that is to say, recording of a sound is started by the recording device 21, for example, and more specifically, the microphone arrangement information is information indicating a direction of each microphone included in the microphone array 31 that is oriented at the predetermined time.

The communication unit 34 transmits the spatial frequency spectrum supplied from the spatial frequency analysis unit 33, to the replay device 22 in a wired or wireless manner.

In addition, the replay device 22 includes a communication unit 41, a sound source separation unit 42, a hearing position detection unit 43, a sound source position correction unit 44, a reproduction area control unit 45, a spatial frequency synthesis unit 46, a temporal frequency synthesis unit 47, and a speaker array 48.

The communication unit 41 receives the spatial frequency spectrum transmitted from the communication unit 34 of the recording device 21, and supplies the spatial frequency spectrum to the sound source separation unit 42.

By performing sound source separation, the sound source separation unit 42 separates the spatial frequency spectrum supplied from the communication unit 41, into an object sound source signal and an ambient signal, and derives sound source position information indicating a position of each object sound source.

The sound source separation unit 42 supplies the object sound source signal and the sound source position information to the sound source position correction unit 44, and supplies the ambient signal to the reproduction area control unit 45.

On the basis of sensor information supplied from the outside, the hearing position detection unit 43 detects a position of a listener in a replay space, and supplies a movement amount Δx of the listener that is obtained from the detection result, to the sound source position correction unit 44 and the reproduction area control unit 45.

Here, examples of the sensor information include information output from an acceleration sensor or a gyro sensor that is attached to the listener, and the like. In this case, the hearing position detection unit 43 detects the position of the listener on the basis of acceleration or a displacement amount of the listener that has been supplied as the sensor information.

In addition, for example, image information obtained by an imaging sensor may be acquired as the sensor information. In this case, data (image information) of an image including the listener as a subject, or data of an ambient image viewed from the listener is acquired as the sensor information, and the hearing position detection unit 43 detects the position of the listener by performing image recognition or the like on the sensor information.

Furthermore, the movement amount Δx is assumed to be, for example, a movement amount from a center position of the speaker array 48, that is to say, a center position of a region surrounded by the speakers included in the speaker array 48, to a center position of the reproduction area. For example, in a case where there is one listener, the position of the listener is regarded as the center position of the reproduction area. In other words, a movement amount of the listener from the center position of the speaker array 48 is directly used as the movement amount Δx. Note that the center position of the reproduction area is assumed to be a position in the region surrounded by the speakers included in the speaker array 48.

On the basis of the movement amount Δx supplied from the hearing position detection unit 43, the sound source position correction unit 44 corrects the sound source position information supplied from the sound source separation unit 42, and supplies corrected sound source position information obtained as a result of the correction, and the object sound source signal supplied from the sound source separation unit 42, to the reproduction area control unit 45.

On the basis of the movement amount Δx supplied from the hearing position detection unit 43, the corrected sound source position information and the object sound source signal that have been supplied from the sound source position correction unit 44, and the ambient signal supplied from the sound source separation unit 42, the reproduction area control unit 45 derives a spatial frequency spectrum in which the reproduction area is moved by the movement amount Δx, and supplies the spatial frequency spectrum to the spatial frequency synthesis unit 46.

On the basis of the speaker arrangement information supplied from the outside, the spatial frequency synthesis unit 46 performs spatial frequency synthesis of the spatial frequency spectrum supplied from the reproduction area control unit 45, and supplies a temporal frequency spectrum obtained as a result of the spatial frequency synthesis, to the temporal frequency synthesis unit 47.

Here, the speaker arrangement information is angle information indicating a direction of the speaker array 48, and more specifically, the speaker arrangement information is angle information indicating a direction of each speaker included in the speaker array 48.

The temporal frequency synthesis unit 47 performs temporal frequency synthesis of the temporal frequency spectrum supplied from the spatial frequency synthesis unit 46, and supplies a temporal signal obtained as a result of the temporal frequency synthesis, to the speaker array 48 as a speaker drive signal.

The speaker array 48 includes an annular speaker array or a spherical speaker array that includes a plurality of speakers, and replays a sound on the basis of the speaker drive signal supplied from the temporal frequency synthesis unit 47.

Subsequently, the units included in the acoustic field controller 11 will be described in more detail.

(Temporal Frequency Analysis Unit)

Using discrete Fourier transform (DFT), the temporal frequency analysis unit 32 performs the temporal frequency transform of a multi-channel recording signal $s(i, n_t)$ obtained by each microphone (hereinafter, also referred to as a microphone unit) included in the microphone array 31 recording a sound, by performing calculation of the following formula (1), and derives a temporal frequency spectrum $S(i, n_{tf})$.

[Math. 1]

$$S(i, n_{tf}) = \sum_{n_t=0}^{M_t-1} s(i, n_t) e^{-j\frac{2\pi n_{tf} n_t}{M_t}} \tag{1}$$

Note that, in Formula (1), i denotes a microphone index for identifying a microphone unit included in the microphone array 31, and the microphone index i=0, 1, 2, . . . , I-1 is obtained. In addition, I denotes the number of microphone units included in the microphone array 31, and $n_t$ denotes a time index.

Furthermore, in Formula (1), $n_{tf}$ denotes a temporal frequency index, $M_t$ denotes the number of samples of DFT, and j denotes a pure imaginary number.

The temporal frequency analysis unit 32 supplies the temporal frequency spectrum $S(i, n_{tf})$ obtained by the temporal frequency transform, to the spatial frequency analysis unit 33.

(Spatial Frequency Analysis Unit)

The spatial frequency analysis unit 33 performs the spatial frequency transform on the temporal frequency spectrum $S(i, n_{tf})$ supplied from the temporal frequency analysis unit 32, using the microphone arrangement information supplied from the outside.

For example, in the spatial frequency transform, the temporal frequency spectrum $S(i, n_{tf})$ is transformed into a spatial frequency spectrum $S'^{m}_{n}(n_{tf})$ using spherical harmonics series expansion. Note that $n_{tf}$ in the spatial frequency spectrum $S'^{m}_{n}(n_{tf})$ denotes a temporal frequency index, and n and m denote an order of a spherical harmonics region.

In addition, the microphone arrangement information is assumed to be angle information including an elevation angle and an azimuth angle that indicate the direction of each microphone unit, for example.

Figure 3:
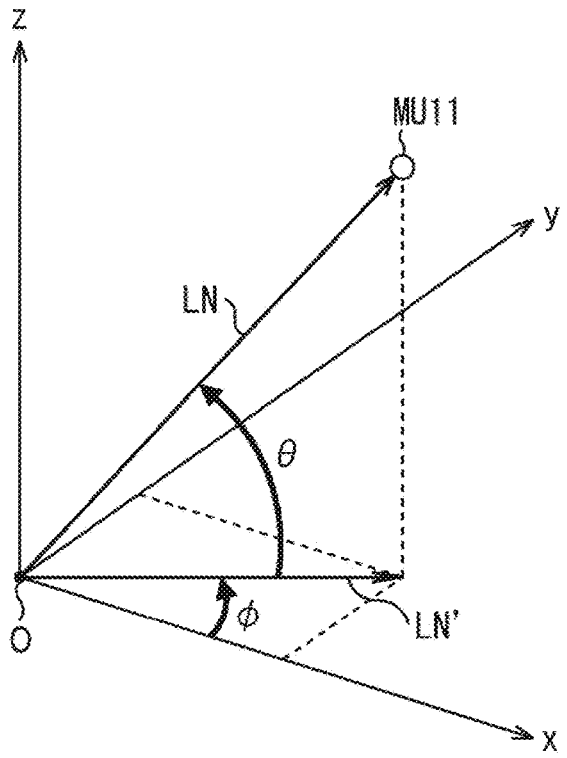
FIG. 3 is a diagram for describing microphone arrangement information.

More specifically, for example, a three-dimensional orthogonal coordinate system that is based on an origin O and has axes corresponding to an x-axis, a y-axis, and a z-axis as illustrated in FIG. 3 will be considered.

At the present moment, a straight line connecting a predetermined microphone unit MU11 included in the microphone array 31, and the origin O is regarded as a straight line LN, and a straight line obtained by projecting the straight line LN from a z-axis direction onto an xy-plane is regarded as a straight line LN'.

At this time, an angle φ formed by the x-axis and the straight line LN' is regarded as an azimuth angle indicating a direction of the microphone unit MU11 viewed from the origin O on the xy-plane. In addition, an angle θ formed by the xy-plane and the straight line LN is regarded as an elevation angle indicating a direction of the microphone unit MU11 viewed from the origin O on a plane vertical to the xy-plane.

The microphone arrangement information will be hereinafter assumed to include information indicating a direction of each microphone unit included in the microphone array 31.

More specifically, for example, information indicating a direction of a microphone unit having a microphone index of i is assumed to be an angle $(\theta_i, \varphi_i)$ indicating a relative direction of the microphone unit with respect to a reference direction. Here, $\theta_i$ denotes an elevation angle of a direction of the microphone unit viewed from the reference direction, and $\varphi_i$ denotes an azimuth angle of the direction of the microphone unit viewed from the reference direction.

Thus, for example, in the example illustrated in FIG. 3, when the x-axis direction is a reference direction, an angle $(\theta_i, \varphi_i)$ of the microphone unit MU11 becomes an elevation angle $\theta_i=\theta$ and an azimuth angle $\varphi_i=\varphi$.

Here, a specific calculation method of the spatial frequency spectrum $S'_n{}^m(n_{tf})$ will be described.

In general, an acoustic field S on a certain sphere can be represented as indicated by the following formula (2).

[Math. 2]

$$S=YWS' \tag{2}$$

Note that, in Formula (2), Y denotes a spherical harmonics matrix, W denotes a weight coefficient that is based on a radius of the sphere and the order of spatial frequency, and S' denotes a spatial frequency spectrum. Such calculation of Formula (2) corresponds to spatial frequency inverse transform.

In addition, by calculating the following formula (3), the spatial frequency spectrum S' can be derived by the spatial frequency transform.

[Math. 3]

$$S'=W^{-1}Y^{+}S \tag{3}$$

Note that, in Formula (3), $Y^+$ denotes a pseudo inverse matrix of the spherical harmonics matrix Y, and is obtained by the following formula (4) using a transposed matrix of the spherical harmonics matrix Y as $Y^T$.

[Math. 4]

$$Y^{+}=(Y^TY)^{-1}Y^T \tag{4}$$

It can be seen from the above that, on the basis of a vector S including the temporal frequency spectrum $S(i, n_{tf})$, a vector S' including the spatial frequency spectrum $S'_n{}^m(n_{tf})$ is obtained by the following formula (5). The spatial frequency analysis unit 33 derives the spatial frequency spectrum $S'_n{}^m(n_{tf})$ by calculating Formula (5), and performing the spatial frequency transform.

[Math. 5]

$$S'=(Y_{mic}{}^TY_{mic})^{-1}Y_{mic}{}^TS \tag{5}$$

Note that, in Formula (5), S' denotes a vector including the spatial frequency spectrum $S'_n{}^m(n_{tf})$, and the vector S' is represented by the following formula (6). In addition, in Formula (5), S denotes a vector including each temporal frequency spectrum $S(i, n_{tf})$, and the vector S is represented by the following formula (7).

Furthermore, in Formula (5), $Y_{mic}$ denotes a spherical harmonics matrix, and the spherical harmonics matrix $Y_{mic}$ is represented by the following formula (8). In addition, in Formula (5), $Y_{mic}{}^T$ denotes a transposed matrix of the spherical harmonics matrix $Y_{mic}$.

Here, in Formula (5), the spherical harmonics matrix $Y_{mic}$ corresponds to the spherical harmonics matrix Y in Formula (4). In addition, in Formula (5), a weight coefficient corresponding to the weight coefficient W indicated by Formula (3) is omitted.

[Math. 6]

$$S' = \begin{bmatrix} S'^0_0(n_{tf}) \\ S'^{-1}_1(n_{tf}) \\ S'^0_1(n_{tf}) \\ \vdots \\ S'^M_N(n_{tf}) \end{bmatrix} \tag{6}$$

[Math. 7]

$$S = \begin{bmatrix} S(0, n_{tf}) \\ S(1, n_{tf}) \\ S(2, n_{tf}) \\ \vdots \\ S(I-1, n_{tf}) \end{bmatrix} \tag{7}$$

[Math. 8]

$$Y_{mic} = \begin{bmatrix} Y^0_0(\theta_0, \phi_0) & Y^{-1}_1(\theta_0, \phi_0) & \cdots & Y^M_N(\theta_0, \phi_0) \\ Y^0_0(\theta_1, \phi_1) & Y^{-1}_1(\theta_1, \phi_1) & \cdots & Y^M_N(\theta_1, \phi_1) \\ \vdots & \vdots & \ddots & \vdots \\ Y^0_0(\theta_{I-1}, \phi_{I-1}) & Y^{-1}_1(\theta_{I-1}, \phi_{I-1}) & \cdots & Y^M_N(\theta_{I-1}, \phi_{I-1}) \end{bmatrix} \tag{8}$$

In addition, $Y_n{}^m(\theta_i, \varphi_i)$ in Formula (8) is a spherical harmonics indicated by the following formula (9).

[Math. 9]

$$Y^m_n(\theta, \phi) = \sqrt{\frac{(2n+1)}{4\pi}\frac{(n-m)!}{(n+m)!}}\, P^m_n(\cos\theta)e^{j\omega\phi} \tag{9}$$

In Formula (9), n and m denote a spherical harmonics region, that is to say, an order of the spherical harmonics $Y_n{}^m(\theta, \varphi)$, j denotes a pure imaginary number, and ω denotes angular frequency.

Furthermore, $\theta_i$ and $\varphi_i$ in the spherical harmonics of Formula (8) respectively denote an elevation angle $\theta_i$ and an azimuth angle $\varphi_i$ included in an angle $(\theta_i, \varphi_i)$ of a microphone unit that is indicated by the microphone arrangement information.

When the spatial frequency spectrum $S'_n{}^m(n_t, f)$ is obtained by the above calculation, the spatial frequency analysis unit 33 supplies the spatial frequency spectrum $S'_n{}^m(n_t, f)$ to the sound source separation unit 42 via the communication unit 34 and the communication unit 41.

Note that a method of deriving a spatial frequency spectrum by spatial frequency transform is described in detail in, for example, "Jerome Daniel, Rozenn Nicol, Sebastien Moreau, "Further Investigations of High Order Ambisonics and Wavefield Synthesis for Holophonic Sound Imaging," AES 114th Convention, Amsterdam, Netherlands, 2003", and the like.

(Sound Source Separation Unit)

By performing sound source separation, the sound source separation unit 42 separates the spatial frequency spectrum $S'_n{}^m(n_t, f)$ supplied from the communication unit 41, into an object sound source signal and an ambient signal, and derives sound source position information indicating a position of each object sound source.

Note that a method of sound source separation may be any method. For example, sound source separation can be performed by a method described in Reference Literature 1 described above.

In this case, on the assumption that, in a recording space, several object sound sources being point sound sources exist near the microphone array 31, and other sound sources are ambient sound sources, a signal of a sound, that is to say, a spatial frequency spectrum is modeled, and separated into signals of the respective sound sources. In other words, in this technology, sound source separation is performed by sparse signal processing. In such sound source separation, a position of each sound source is also identified.

Note that, in performing the sound source separation, the number of sound sources to be separated may be restricted by a reference of some sort. This reference is considered to be the number of sound sources itself, a distance from the center of the reproduction area, or the like, for example. In other words, for example, the number of sound sources separated as object sound sources may be predefined, or a sound source having a distance from the center of the reproduction area, that is to say, a distance from the center of the microphone array 31 that is equal to or smaller than a predetermined distance may be separated as an object sound source.

The sound source separation unit 42 supplies sound source position information indicating a position of each object sound source that has been obtained as a result of the sound source separation, and the spatial frequency spectrum $S'_n{}^m(n_t, f)$ separated as object sound source signals of these object sound sources, to the sound source position correction unit 44.

In addition, the sound source separation unit 42 supplies the spatial frequency spectrum $S'_n{}^m(n_t, f)$ separated as the ambient signal as a result of the sound source separation, to the reproduction area control unit 45.

(Hearing Position Detection Unit)

The hearing position detection unit 43 detects a position of the listener in the replay space, and derives a movement amount $\Delta x$ of the listener on the basis of the detection result.

Figure 4:
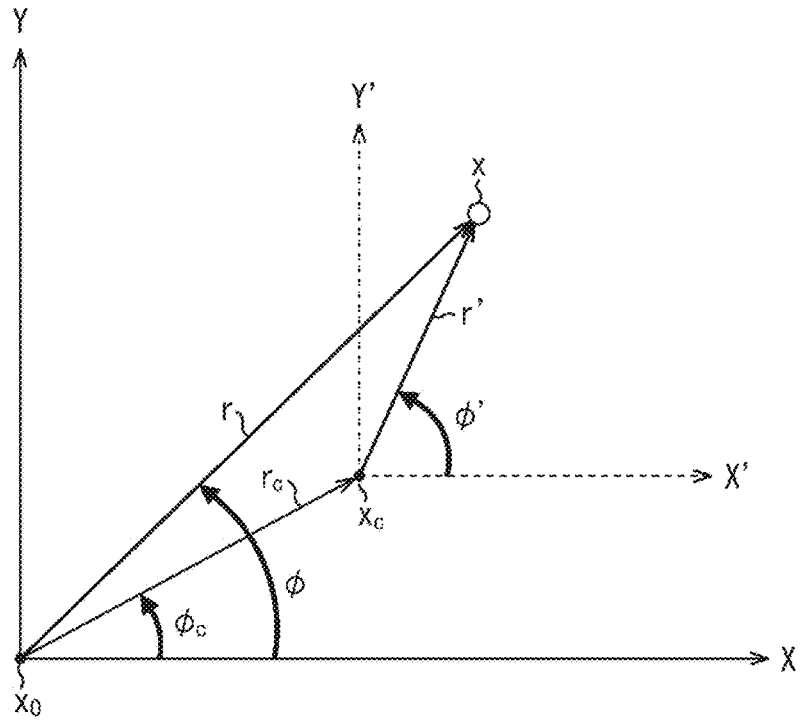
FIG. 4 is a diagram for describing correction of sound source position information.

Specifically, for example, a center position of the speaker array 48 is at a position $x_0$ on a two-dimensional plane as illustrated in FIG. 4, and a coordinate of the center position will be referred to as a central coordinate $x_0$.

Note that only a two-dimensional plane is considered for the sake of simplicity of description, and the central coordinate $x_0$ is assumed to be a coordinate of a spherical-coordinate system, for example.

In addition, on the two-dimensional plane, a center position of the reproduction area that is derived on the basis of the position of the listener is a position $x_c$, and a coordinate indicating the center position of the reproduction area will be referred to as a central coordinate $x_c$. It should be noted that the center position $x_c$ is provided on the inside of the speaker array 48, that is to say, provided in a region surrounded by the speaker units included in the speaker array 48. In addition, the central coordinate $x_c$ is also assumed to be a coordinate of a spherical-coordinate system similarly to the central coordinate $x_0$.

For example, in a case where only one listener exists within the replay space, a position of a head portion of the listener is detected by the hearing position detection unit 43, and the head portion position of the listener is directly used as the center position $x_c$ of the reproduction area.

In contrast to this, in a case where a plurality of listeners exists in the replay space, positions of head portions of these listeners are detected by the hearing position detection unit 43, and a center position of a circle that encompasses the positions of the head portions of all of these listeners, and has the minimum radius is used as the center position $x_c$ of the reproduction area.

Note that, in a case where a plurality of listeners exists within the replay space, the center position $x_c$ of the reproduction area may be defined by another method. For example, a centroid position of the position of the head portion of each listener may be used as the center position $x_c$ of the reproduction area.

When the center position $x_c$ of the reproduction area is derived in this manner, the hearing position detection unit 43 derives a movement amount $\Delta x$ by calculating the following formula (10).

[Math. 10]

$$\Delta x = x_c - x_0 \tag{10}$$

FIG. 4 illustrates a vector $r_c$ having a starting point corresponding to the position $x_0$ and an ending point corresponding to the position $x_c$ indicates a movement amount $\Delta x$, and in the calculation of Formula (10), a movement amount $\Delta x$ represented by a spherical coordinate is derived. Thus, when the listener is assumed to be at the position $x_0$ at the start time of acoustic field reproduction, the movement amount $\Delta x$ can be referred to as a movement amount of a head portion of the listener, and can also be referred to as a movement amount of the center position of the reproduction area.

In addition, when the center position of the reproduction area is at the position $x_0$ at the start time of acoustic field reproduction, and a predetermined object sound source is at the position x on the two-dimensional plane, a position of the object sound source viewed from the center position of the reproduction area at the start time of acoustic field reproduction is a position indicated by the vector r.

In contrast to this, when the center position of the reproduction area moves from the original position $x_0$ to the position $x_c$, a position of the object sound source viewed from the center position of the reproduction area after the movement becomes a position indicated by a vector r'.

In this case, the position of the object sound source viewed from the center position of the reproduction area after the movement changes from that obtained before the movement by an amount corresponding to the vector $r_c$, that is to say, by an amount corresponding to the movement amount $\Delta x$. Thus, for moving only the reproduction area in the replay space, and leaving the position of the object sound source fixed, it is necessary to appropriately correct the position x of the object sound source, and the correction is performed by the sound source position correction unit 44.

Note that the position x of the object sound source viewed from the position $x_0$ is represented by a spherical coordinate using a radius r being a size of the vector r illustrated in FIG. 4, and an azimuth angle $\varphi$, as $x=(r, \varphi)$. In a similar manner, the position x of the object sound source viewed from the position $x_c$ after the movement is represented by a spherical coordinate using a radius r' being a size of the vector r' illustrated in FIG. 4, and an azimuth angle $\varphi'$, as $x=(r', \varphi')$.

Furthermore, the movement amount $\Delta x$ can also be represented by a spherical coordinate using a radius $r_c$ being a size of a vector $r_c$, and an azimuth angle $\varphi_c$, as $\Delta x=(r_c, \varphi_c)$. Note that an example of representing each position and a movement amount using a spherical coordinate is described here, but each position and a movement amount may be represented using an orthogonal coordinate.

The hearing position detection unit 43 supplies the movement amount $\Delta x$ obtained by the above calculation, to the sound source position correction unit 44 and the reproduction area control unit 45.

(Sound Source Position Correction Unit)

On the basis of the movement amount $\Delta x$ supplied from the hearing position detection unit 43, the sound source position correction unit 44 corrects the sound source position information supplied from the sound source separation unit 42, to obtain the corrected sound source position information. In other words, in the sound source position correction unit 44, a position of each object sound source is corrected in accordance with a sound hearing position of the listener.

Specifically, for example, a coordinate indicating a position of an object sound source that is indicated by the sound source position information is assumed to be $x_{obj}$ (hereinafter, also referred to as a sound source position coordinate $x_{obj}$), and a coordinate indicating a corrected position of the object sound source that is indicated by the corrected sound source position information is assumed to be $x'_{obj}$ (hereinafter, also referred to as a corrected sound source position coordinate $x'_{obj}$). Note that the sound source position coordinate $x_{obj}$ and the corrected sound source position coordinate $x'_{obj}$ are represented by spherical coordinates, for example.

The sound source position correction unit 44 calculates the corrected sound source position coordinate $x'_{obj}$ by calculating the following formula (11) from the sound source position coordinate $x_{obj}$ and the movement amount $\Delta x$.

[Math. 11]

$$x'_{obj}=x_{obj}-\Delta x \tag{11}$$

Based on this, the position of the object sound source is moved by an amount corresponding to the movement amount $\Delta x$, that is to say, by an amount corresponding to the movement of the sound hearing position of the listener.

The sound source position coordinate $x_{obj}$ and the corrected sound source position coordinate $x'_{obj}$ serve as information pieces that are respectively based on the center positions of the reproduction area that are set before and after the movement, that is to say, information pieces indicating the positions of each object sound source viewed from the position of the listener. In this manner, if the sound source position coordinate $x_{obj}$ indicating the position of the object sound source is corrected by an amount corresponding to the movement amount $\Delta x$ on the replay space, to obtain the corrected sound source position coordinate $x'_{obj}$, when viewed in the replay space, the position of the object sound source that is set after the correction remains at the same position as that set before the correction.

In addition, the sound source position correction unit 44 directly uses the corrected sound source position coordinate $x'_{obj}$ represented by a spherical coordinate that has been obtained by the calculation of Formula (11), as the corrected sound source position information.

For example, in a case where only the two-dimensional plane illustrated in FIG. 4 is considered, when the position of the object sound source is assumed to be the position x, in the spherical-coordinate system, the corrected sound source position coordinate $x'_{obj}$ can be represented as $x'_{obj}=(r', \varphi')$ where a size of the vector r' is denoted by r' and an azimuth angle of the vector r' is denoted by $\varphi'$. Thus, the corrected sound source position coordinate $x'_{obj}$ becomes a coordinate indicating a relative position of the object sound source viewed from the center position of the reproduction area that is set after the movement.

The sound source position correction unit 44 supplies the corrected sound source position information derived in this manner, and the object sound source signal supplied from the sound source separation unit 42, to the reproduction area control unit 45.

(Reproduction Area Control Unit)

On the basis of the movement amount $\Delta x$ supplied from the hearing position detection unit 43, the corrected sound source position information and the object sound source signal that have been supplied from the sound source position correction unit 44, and the ambient signal supplied from the sound source separation unit 42, the reproduction area control unit 45 derives the spatial frequency spectrum $S''^{m}_{n}(n_{tf})$ obtained when the reproduction area is moved by the movement amount $\Delta x$. In other words, the spatial frequency spectrum $S''^{m}_{n}(n_{tf})$ is obtained by moving the reproduction area by the movement amount $\Delta x$ in a state in which a sound image (sound source) position is fixed, with respect to the spatial frequency spectrum $S'^{m}_{n}(n_{tf})$.

Nevertheless, for the sake of simplicity of description, the description will now be given of a case in which speakers included in the speaker array 48 are annularly arranged on a two-dimensional coordinate system, and a spatial frequency spectrum is calculated using annular harmonics in place of the spherical harmonics. Hereinafter, a spatial frequency spectrum calculated by using the annular harmonics that corresponds to the spatial frequency spectrum $S''^{m}_{n}(n_{tf})$ will be described as a spatial frequency spectrum $S'_{n}(n_{tf})$.

The spatial frequency spectrum $S'_{n}(n_{tf})$ can be resolved as indicated by the following formula (12).

[Math. 12]

$$S'_{n}(n_{tf})=S''(n_{tf})J_{n}(n_{tf}, r) \tag{12}$$

Note that, in Formula (12), $S''_{n}(n_{tf})$ denotes a spatial frequency spectrum, and $J_{n}(n_{tf}, r)$ denotes an n-order Bessel function.

In addition, the temporal frequency spectrum $S(n_{tf})$ obtained when the center position $x_c$ of the reproduction area that is set after the movement is regarded as the center can be represented as indicated by the following formula (13).

[Math. 13]

$$S(n_{tf}) = \sum_{n'=-N'}^{N'} S''_n \cdot (n_{tf}) J_n \cdot (n_{tf}, r') e^{jn'\phi'} \tag{13}$$

Note that, in Formula (13), j denotes a pure imaginary number, and r' and φ' respectively denote a radius and an azimuth angle that indicate a position of a sound source viewed from the center position $x_c$.

The spatial frequency spectrum obtained when the center position $x_0$ of the reproduction area that is set before the movement is regarded as the center can be derived from this by deforming Formula (13) as indicated by the following formula (14).

[Math. 14]

$$S(n_{tf}) = \sum_{n=-\infty}^{\infty} \sum_{n'=-N'}^{N'} S''_{n'}(n_{tf}) J_{n-n'}(n_{tf}, r_c) e^{-j(n-n')\phi_c} \times J_n(n_{tf}, r) e^{jn\phi} \tag{14}$$

Note that, in Formula (14), r and φ respectively denote a radius and an azimuth angle that indicate a position of a sound source viewed from the center position $x_0$, and $r_c$ and $\varphi_c$ respectively denote a radius and an azimuth angle of the movement amount Δx.

The resolution of the spatial frequency spectrum that is performed by Formula (12), the deformation indicated by Formula (14), and the like are described in detail in "Jens Ahrens, Sascha Spors, "An Analytical Approach to Sound Field Reproduction with a Movable Sweet Spot Using Circular Distributions of Loudspeakers," ICASSP, 2009." or the like, for example.

Furthermore, from Formulae (12) to (14) described above, the spatial frequency spectrum $S'_n(n_{tf})$ to be derived can be represented as in the following formula (15). The calculation of this formula (15) corresponds to a process of moving an acoustic field on a spherical coordinate system.

[Math. 15]

$$\begin{aligned} S'_n(n_{tf}) &= S''_n(n_{tf}) J_n(n_{tf}, r) \\ &= \sum_{n'=-N'}^{N'} S''_{n'}(n_{tf}) J_{n-n'}(n_{tf}, r_c) e^{-j(n-n')\phi_c} \times J_n(n_{tf}, r) \end{aligned} \tag{15}$$

By calculating Formula (15) on the basis of the movement amount $\Delta x = (r_c, \varphi_c)$, the corrected sound source position coordinate $x'_{obj} = (r', \varphi')$ serving as the corrected sound source position information, the object sound source signal, and the ambient signal, the reproduction area control unit 45 derives the spatial frequency spectrum $S'_n(n_{tf})$.

Nevertheless, at the time of calculation of Formula (15), the reproduction area control unit 45 uses, as a spatial frequency spectrum $S''_n(n_{tf})$ of the object sound source signal, a value obtained by multiplying a spatial frequency spectrum serving as an object sound source signal, by a spherical wave model $S''_{n',sw}$ represented by the corrected sound source position coordinate $x'_{obj}$ that is indicated by the following formula (16).

[Math. 16]

$$S''_{n',sw} = j/4H_{n'}^{(2)}(n_{tf}, r'_s) e^{-jn'\varphi'_s} \tag{16}$$

Note that, in Formula (16), $r'_s$ and $\varphi'_s$ respectively denote a radius and an azimuth angle of the corrected sound source position coordinate $x'_{obj}$ of the predetermined object sound source, and correspond to the above-described corrected sound source position coordinate $x'_{obj} = (r', \varphi')$. In other words, for distinguishing object sound sources, a radius r' and an azimuth angle φ' are marked with a character S for identifying an object sound source, to be described as $r'_s$ and $\varphi'_s$. In addition, $H_{n'}^{(2)}(n_{tf}, r'_s)$ denotes a second-type n'-order Hankel function.

The spherical wave model $S''_{n',sw}$ indicated by Formula (16) can be obtained from the corrected sound source position coordinate $x'_{obj}$.

In contrast to this, at the time of calculation of Formula (15), the reproduction area control unit 45 uses, as a spatial frequency spectrum $S''_{n'}(n_{tf})$ of an ambient signal, a value obtained by multiplying a spatial frequency spectrum serving as an ambient signal, by a spherical wave model $S''_{n',PW}$ indicated by the following formula (17).

[Math. 17]

$$S''_{n',pw} = J^{-n'} e^{-jn'\varphi_{pw}} \tag{17}$$

Note that, in Formula (17), $\varphi_{PW}$ denotes a planar wave arrival direction, and the arrival direction $\varphi_{PW}$ is assumed to be, for example, a direction identified by an arrival direction estimation technology of some sort at the time of sound source separation in the sound source separation unit 42, a direction designated by an external input, and the like. The spherical wave model $S''_{n',PW}$ indicated by Formula (17) can be obtained from the arrival direction $\varphi_{PW}$.

By the above calculation, the spatial frequency spectrum $S'_n(n_{tf})$ in which the center position of the reproduction area is moved in the replay space by the movement amount Δx, and the reproduction area is caused to follow the movement of the listener can be obtained. In other words, the spatial frequency spectrum $S'_n(n_{tf})$ of the reproduction area adjusted in accordance with the sound hearing position of the listener can be obtained. In this case, the center position of the reproduction area of an acoustic field reproduced by the spatial frequency spectrum $S'_n(n_{tf})$ becomes a hearing position set after the movement that is provided on the inside of the annular or spherical speaker array 48.

In addition, although the case in the two-dimensional coordinate system has been described here as an example, similar calculation can be performed using spherical harmonics also in the case in a three-dimensional coordinate system. In other words, an acoustic field (reproduction area) can be moved on the spherical coordinate system using spherical harmonics.

The calculation performed in the case of using the spherical harmonics is described in detail in, for example, "Jens Ahrens, Sascha Spors, "An Analytical Approach to 2.5D Sound Field Reproduction Employing Circular Distributions of Non-Omnidirectional Loudspeakers," EUSIPCO, 2009.", and the like.

The reproduction area control unit 45 supplies the spatial frequency spectrum $S''^{m}_{n}(n_{tf})$ that has been obtained by moving the reproduction area while fixing a sound image on the spherical coordinate system, using the spherical harmonics, to the spatial frequency synthesis unit 46.

(Spatial Frequency Synthesis Unit)

The spatial frequency synthesis unit 46 performs the spatial frequency inverse transform on the spatial frequency spectrum $S''^{m}_{n}(n_{tf})$ supplied from the reproduction area control unit 45, using a spherical harmonics matrix that is based on an angle $(\xi_1, \psi_1)$ indicating a direction of each speaker included in the speaker array 48, and derives a temporal frequency spectrum. In other words, the spatial frequency inverse transform is performed as the spatial frequency synthesis.

Note that each speaker included in the speaker array 48 will be hereinafter also referred to as a speaker unit. Here, the number of speaker units included in the speaker array 48 is denoted by the number of speaker units L, and a speaker unit index indicating each speaker unit is denoted by 1. In this case, the speaker unit index 1=0, 1, . . . , L-1 is obtained.

At the present moment, the speaker arrangement information supplied to the spatial frequency synthesis unit 46 from the outside is assumed to be an angle ($\xi_1$, $\psi_1$) indicating a direction of each speaker unit denoted by the speaker unit index 1.

Here, $\xi_1$ and $\omega_1$ that are included in the angle ($\xi_1$, $\psi_1$) of the speaker unit are angles respectively indicating an elevation angle and an azimuth angle of the speaker unit that respectively correspond to the above-described elevation angle $\theta_i$ and azimuth angle $\varphi_i$, and are angles from a predetermined reference direction.

By calculating the following formula (18) on the basis of the spherical harmonics $Y_n^m$ ($\xi_1$, $\psi_1$) obtained for the angle ($\xi_1$, $\psi_1$) indicating the direction of the speaker unit denoted by the speaker unit index 1, and the spatial frequency spectrum $S''_n{}^m$ ($n_{tf}$), the spatial frequency synthesis unit 46 performs the spatial frequency inverse transform, and derives a temporal frequency spectrum D(1, $n_{tf}$).

[Math. 18]

$$D=Y_{sp}S_{sp} \tag{18}$$

Note that, in Formula (18), D denotes a vector including each temporal frequency spectrum D (1, $n_{tf}$), and the vector D is represented by the following formula (19). In addition, in Formula (18), $S_{SP}$ denotes a vector including each spatial frequency spectrum $S''_n{}^m$ ($n_{tf}$), and the vector $S_{SP}$ is represented by the following formula (20).

Furthermore, in Formula (18), $Y_{SP}$ denotes a spherical harmonics matrix including each spherical harmonics $Y_n^m$ ($\xi_1$, $\psi_1$), and the spherical harmonics matrix $Y_{SP}$ is represented by the following formula (21).

[Math. 19]

$$D=\begin{bmatrix} D(0, n_{tf}) \\ D(1, n_{tf}) \\ D(2, n_{tf}) \\ \vdots \\ D(L-1, n_{tf}) \end{bmatrix} \tag{19}$$

[Math. 20]

$$S_{sp}=\begin{bmatrix} S_0''^0(n_{tf}) \\ S_1''^{-1}(n_{tf}) \\ S_1''^0(n_{tf}) \\ \vdots \\ S_N''^M(n_{tf}) \end{bmatrix} \tag{20}$$

[Math. 21]

$$Y_{sp}=\begin{bmatrix} Y_0^0(\xi_0, \psi_0) & Y_1^{-1}(\xi_0, \psi_0) & \cdots & Y_N^M(\xi_0, \psi_0) \\ Y_0^0(\xi_1, \psi_1) & Y_1^{-1}(\xi_1, \psi_1) & \cdots & Y_N^M(\xi_1, \psi_1) \\ \vdots & \vdots & \ddots & \vdots \\ Y_0^0(\xi_{L-1}, \psi_{L-1}) & Y_1^{-1}(\xi_{L-1}, \psi_{L-1}) & \cdots & Y_N^M(\xi_{L-1}, \psi_{L-1}) \end{bmatrix} \tag{21}$$

The spatial frequency synthesis unit 46 supplies the temporal frequency spectrum D(1, $n_{tf}$) obtained in this manner, to the temporal frequency synthesis unit 47.

(Temporal Frequency Synthesis Unit)

By calculating the following formula (22), the temporal frequency synthesis unit 47 performs the temporal frequency synthesis using inverse discrete Fourier transform (IDFT), on the temporal frequency spectrum D(1, $n_{tf}$) supplied from the spatial frequency synthesis unit 46, and calculates a speaker drive signal d(1, $n_d$) being a temporal signal.

[Math. 22]

$$d(I, n_d)=\frac{1}{M_{dt}}\sum_{n_{tf}=0}^{M_{dt}-1} D(I, n_{tf})e^{j\frac{2\pi n_d n_{tf}}{M_{dt}}} \tag{22}$$

Note that, in Formula (22), $n_d$ denotes a time index, and $M_{dt}$ denotes the number of samples of IDFT. In addition, in Formula (22), j denotes a pure imaginary number.

The temporal frequency synthesis unit 47 supplies the speaker drive signal d(1, $n_d$) obtained in this manner, to each speaker unit included in the speaker array 48, and causes the speaker unit to reproduce a sound.

<Description of Acoustic Field Reproduction Process>

Next, an operation of the acoustic field controller 11 will be described. When recording and reproduction of an acoustic field are instructed, the acoustic field controller 11 performs an acoustic field reproduction process to reproduce an acoustic field of a recording space in a replay space. The acoustic field reproduction process performed by the acoustic field controller 11 will be described below with reference to a flowchart in FIG. 5.

In Step S11, the microphone array 31 records a sound of content in the recording space, and supplies a multi-channel recording signal s(i, $n_t$) obtained as a result of the recording, to the temporal frequency analysis unit 32.

In Step S12, the temporal frequency analysis unit 32 analyzes temporal frequency information of the recording signal s(i, $n_t$) supplied from the microphone array 31.

Specifically, the temporal frequency analysis unit 32 performs the temporal frequency transform of the recording signal s(i, $n_t$), and supplies the temporal frequency spectrum S(i, $n_{tf}$) obtained as a result of the temporal frequency transform, to the spatial frequency analysis unit 33. For example, in Step S12, calculation of the above-described formula (1) is performed.

In Step S13, the spatial frequency analysis unit 33 performs the spatial frequency transform on the temporal frequency spectrum S(i, $n_{tf}$) supplied from the temporal frequency analysis unit 32, using the microphone arrangement information supplied from the outside.

Specifically, by calculating the above-described formula (5) on the basis of the microphone arrangement information and the temporal frequency spectrum S(i, $n_{tf}$), the spatial frequency analysis unit 33 performs the spatial frequency transform.

The spatial frequency analysis unit 33 supplies the spatial frequency spectrum $S'_n{}^m$ ($n_{tf}$) obtained by the spatial frequency transform, to the communication unit 34.

In Step S14, the communication unit 34 transmits the spatial frequency spectrum $S'_n{}^m$ ($n_{tf}$) supplied from the spatial frequency analysis unit 33.

In Step S15, the communication unit 41 receives the spatial frequency spectrum $S'_n{}^m$ ($n_{tf}$) transmitted by the communication unit 34, and supplies the spatial frequency spectrum $S'_n{}^m$ ($n_{tf}$) to the sound source separation unit 42.

In Step S16, the sound source separation unit 42 performs the sound source separation on the basis of the spatial frequency spectrum $S'^{m}_{n}(n_{tf})$ supplied from the communication unit 41, and separates the spatial frequency spectrum $S'^{m}_{n}(n_{tf})$ into a signal serving as an object sound source signal, and a signal serving as an ambient signal.

The sound source separation unit 42 supplies the sound source position information indicating a position of each object sound source that has been obtained as a result of the sound source separation, and the spatial frequency spectrum $S'^{m}_{n}(n_{tf})$ serving as an object sound source signal, to the sound source position correction unit 44. In addition, the sound source separation unit 42 supplies the spatial frequency spectrum $S'^{m}_{n}(n_{tf})$ serving as an ambient signal, to the reproduction area control unit 45.

In Step S17, the hearing position detection unit 43 detects the position of the listener in the replay space on the basis of the sensor information supplied from the outside, and derives a movement amount $\Delta x$ of the listener on the basis of the detection result.

Specifically, the hearing position detection unit 43 derives the position of the listener on the basis of the sensor information, and calculates, from the position of the listener, the center position $x_c$ of the reproduction area that is set after the movement. Then, the hearing position detection unit 43 calculates the movement amount $\Delta x$ from the center position $x_c$, and the center position $x_0$ of the speaker array 48 that has been derived in advance, using Formula (10).

The hearing position detection unit 43 supplies the movement amount $\Delta x$ obtained in this manner, to the sound source position correction unit 44 and the reproduction area control unit 45.

In Step S18, the sound source position correction unit 44 corrects the sound source position information supplied from the sound source separation unit 42, on the basis of the movement amount $\Delta x$ supplied from the hearing position detection unit 43.

In other words, the sound source position correction unit 44 performs calculation of Formula (11) from the sound source position coordinate $x_{obj}$ serving as the sound source position information, and the movement amount $\Delta x$, and calculates the corrected sound source position coordinate $x'_{obj}$ serving as the corrected sound source position information.

The sound source position correction unit 44 supplies the obtained corrected sound source position information and the object sound source signal supplied from the sound source separation unit 42, to the reproduction area control unit 45.

In Step S19, on the basis of the movement amount $\Delta x$ from the hearing position detection unit 43, the corrected sound source position information and the object sound source signal from the sound source position correction unit 44, and the ambient signal from the sound source separation unit 42, the reproduction area control unit 45 derives the spatial frequency spectrum $S''^{m}_{n}(n_{tf})$ in which the reproduction area is moved by the movement amount $\Delta x$.

In other words, the reproduction area control unit 45 derives the spatial frequency spectrum $S''^{m}_{n}(n_{tf})$ by performing calculation similar to Formula (15) using the spherical harmonics, and supplies the obtained spatial frequency spectrum $S''^{m}_{n}(n_{tf})$ to the spatial frequency synthesis unit 46.

In Step S20, on the basis of the spatial frequency spectrum $S''^{m}_{n}(n_{tf})$ supplied from the reproduction area control unit 45, and the speaker arrangement information supplied from the outside, the spatial frequency synthesis unit 46 calculates the above-described formula (18), and performs the spatial frequency inverse transform. The spatial frequency synthesis unit 46 supplies the temporal frequency spectrum $D(1, n_{tf})$ obtained by the spatial frequency inverse transform, to the temporal frequency synthesis unit 47.

In Step S21, by calculating the above-described formula (22), the temporal frequency synthesis unit 47 performs the temporal frequency synthesis on the temporal frequency spectrum $D(1, n_{tf})$ supplied from the spatial frequency synthesis unit 46, and calculates the speaker drive signal $d(1, n_d)$.

The temporal frequency synthesis unit 47 supplies the obtained speaker drive signal $d(1, n_d)$ to each speaker unit included in the speaker array 48.

In Step S22, the speaker array 48 replays a sound on the basis of the speaker drive signal $d(1, n_d)$ supplied from the temporal frequency synthesis unit 47. A sound of content, that is to say, an acoustic field of the recording space is thereby reproduced.

When the acoustic field of the recording space is reproduced in the replay space in this manner, the acoustic field reproduction process ends.

In the above-described manner, the acoustic field controller 11 corrects the sound source position information of the object sound source, and derives the spatial frequency spectrum in which the reproduction area is moved using the corrected sound source position information.

With this configuration, a reproduction area can be moved in accordance with a motion of a listener, and a position of an object sound source can be fixed in the replay space. As a result, a correctly-reproduced acoustic field can be presented to the listener, and furthermore, feeling of localization of the sound source can be enhanced, so that the acoustic field can be reproduced more appropriately. Moreover, in the acoustic field controller 11, sound sources are separated into an object sound source and an ambient sound source, and the correction of a sound source position is performed only for the object sound source. A calculation amount can be thereby reduced.

Second Embodiment

<Configuration Example of Acoustic Field Controller>

Note that, although the case of reproducing an acoustic field obtained by recording a wave surface using the microphone array 31 has been described above, sound source separation becomes unnecessary in the case of performing object sound replay because sound source position information is granted as metadata.

Figure 6:
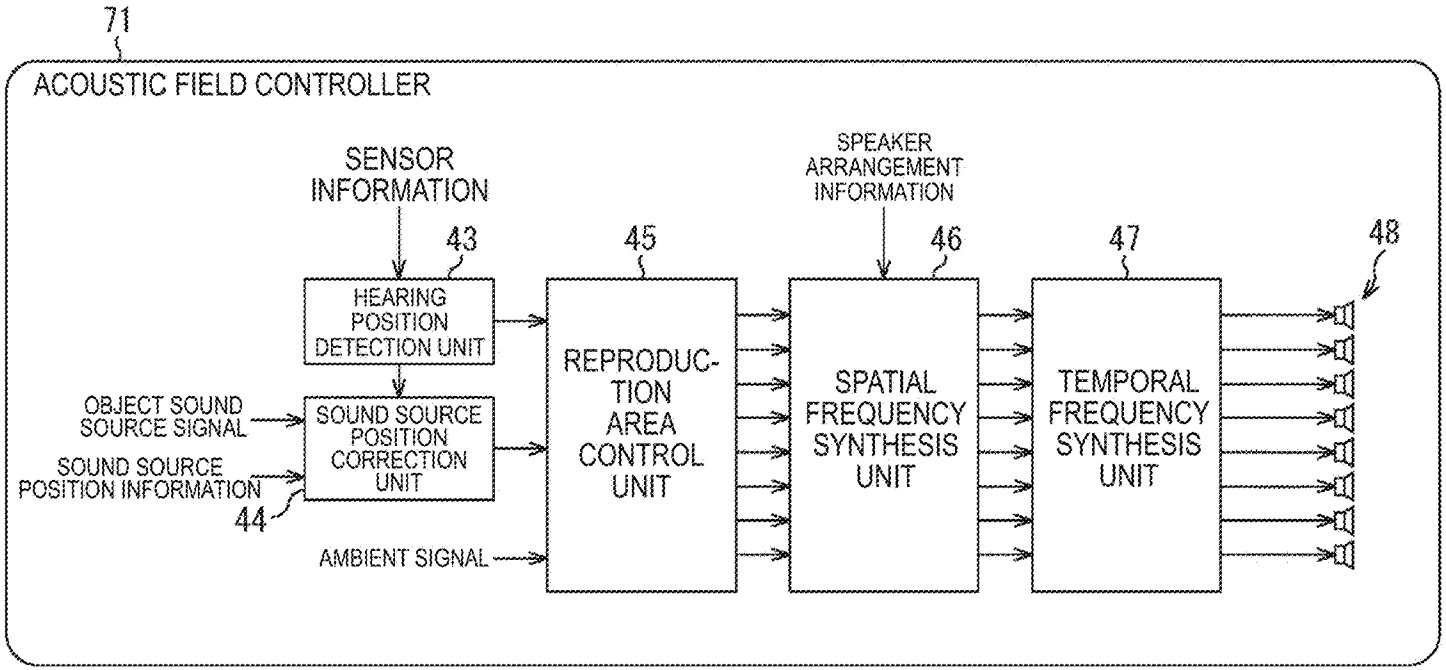
FIG. 6 is a diagram illustrating a configuration example of an acoustic field controller.

In such a case, an acoustic field controller to which the present technology is applied has a configuration illustrated in FIG. 6, for example. Note that, in FIG. 6, parts corresponding to those in the case in FIG. 2 are assigned the same signs, and the description will be appropriately omitted.

An acoustic field controller 71 illustrated in FIG. 6 includes the hearing position detection unit 43, the sound source position correction unit 44, the reproduction area control unit 45, the spatial frequency synthesis unit 46, the temporal frequency synthesis unit 47, and the speaker array 48.

In this example, the acoustic field controller 71 acquires an audio signal of each object and metadata thereof from the outside, and separates objects into an object sound source and an ambient sound source on the basis of importance degrees or the like of the objects that are included in the metadata, for example.

Then, the acoustic field controller 71 supplies an audio signal of an object separated as an object sound source, to the sound source position correction unit 44 as an object sound source signal, and also supplies sound source position information included in the metadata of the object sound source, to the sound source position correction unit 44.

In addition, the acoustic field controller 71 supplies an audio signal of an object separated as an ambient sound source, to the reproduction area control unit 45 as an ambient signal, and also supplies, as necessary, sound source position information included in the metadata of the ambient sound source, to the reproduction area control unit 45.

Note that, in this embodiment, an audio signal supplied as an object sound source signal or an ambient signal may be a spatial frequency spectrum similarly to the case of being supplied to the sound source position correction unit 44 or the like in the acoustic field controller 11 in FIG. 2, or a temporal signal or a temporal frequency spectrum, or a combination of these.

For example, in a case where an audio signal is assumed to be a temporal signal or a temporal frequency spectrum, in the reproduction area control unit 45, after the temporal signal or the temporal frequency spectrum is transformed into a spatial frequency spectrum, a spatial frequency spectrum in which a reproduction area is moved is derived.

<Description of Acoustic Field Reproduction Process>

Figure 7:
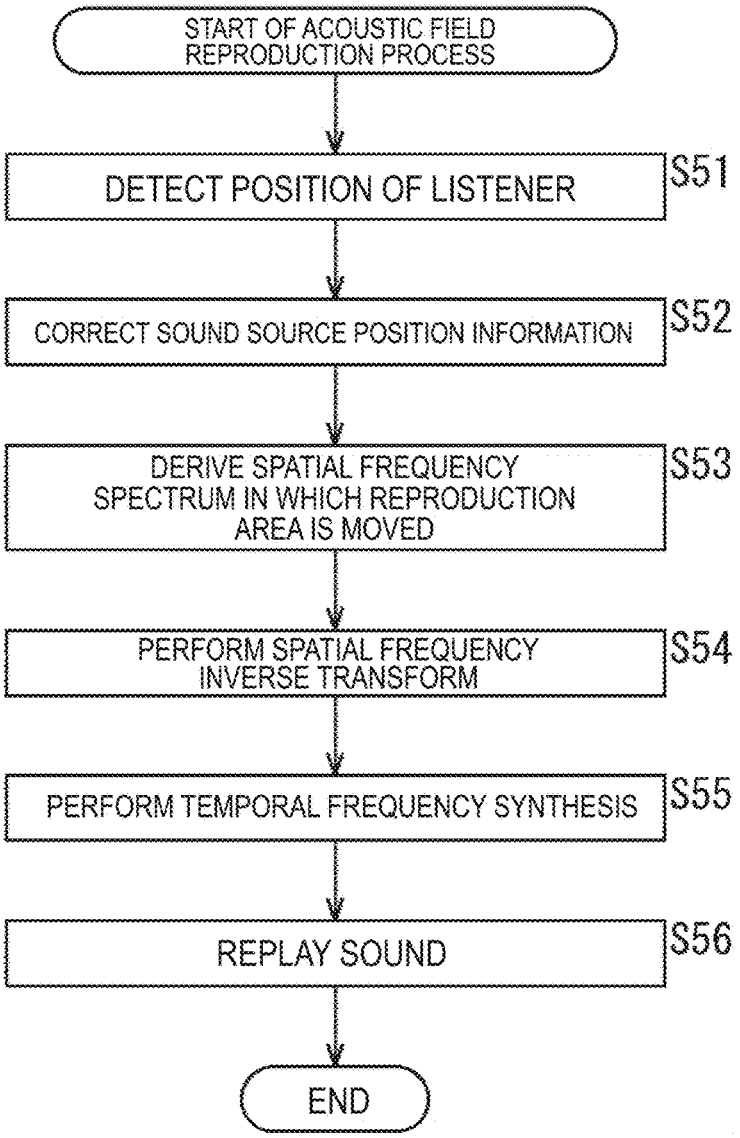
FIG. 7 is a flowchart for describing an acoustic field reproduction process

Next, an acoustic field reproduction process performed by the acoustic field controller 71 illustrated in FIG. 6 will be described with reference to a flowchart in FIG. 7. Note that because a process in Step S51 is similar to the process in Step S17 in FIG. 5, the description will be omitted.

In Step S52, the sound source position correction unit 44 corrects the sound source position information supplied from the acoustic field controller 71, on the basis of the movement amount $\Delta x$ supplied from the hearing position detection unit 43.

In other words, the sound source position correction unit 44 performs calculation of Formula (11) from the sound source position coordinate $x_{obj}$ serving as the sound source position information that has been supplied as metadata, and the movement amount $\Delta x$, and calculates the corrected sound source position coordinate $x'_{obj}$ serving as the corrected sound source position information.

The sound source position correction unit 44 supplies the obtained corrected sound source position information, and the object sound source signal supplied from the acoustic field controller 71, to the reproduction area control unit 45.

In Step S53, on the basis of the movement amount $\Delta x$ from the hearing position detection unit 43, the corrected sound source position information and the object sound source signal from the sound source position correction unit 44, and the ambient signal from the acoustic field controller 71, the reproduction area control unit 45 derives the spatial frequency spectrum $S''^{m}_{n}(n_{tf})$ in which the reproduction area is moved by the movement amount $\Delta x$.

Figure 5:
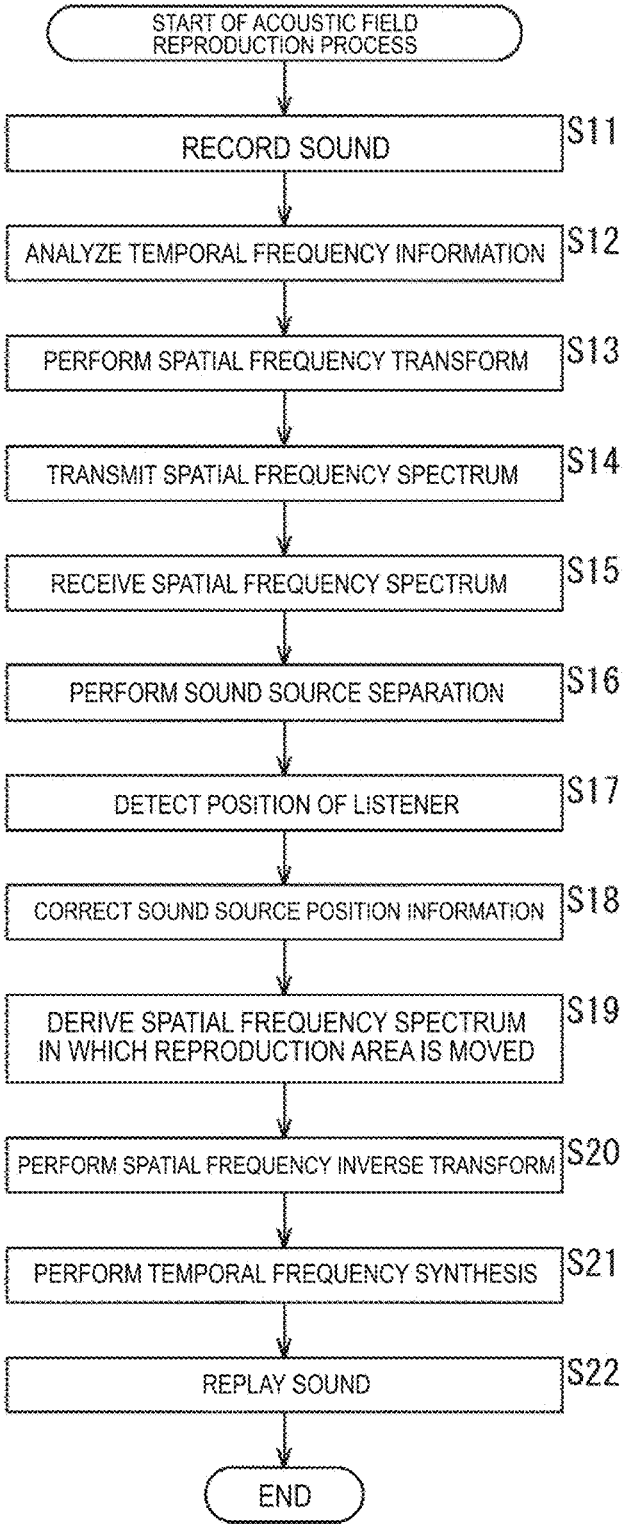
FIG. 5 is a flowchart for describing an acoustic field reproduction process.

For example, in Step S53, similarly to the case in Step S19 in FIG. 5, by the calculation using the spherical harmonics, the spatial frequency spectrum $S''^{m}_{n}(n_{tf})$ in which the acoustic field (reproduction area) is moved is derived and supplied to the spatial frequency synthesis unit 46. At this time, in a case where the object sound source signal and the ambient signal are temporal signals or temporal frequency spectrums, after the transform into spatial frequency spectrums is appropriately performed, calculation similar to Formula (15) is performed.

When the spatial frequency spectrum $S''^{m}_{n}(n_{tf})$ is derived, after that, processes in Steps S54 to S56 are performed, and the acoustic field reproduction process ends. The processes are similar to the processes in Steps S20 to S22 in FIG. 5. Thus, the description will be omitted.

In the above-described manner, the acoustic field controller 71 corrects the sound source position information of the object sound source, and derives a spatial frequency spectrum in which the reproduction area is moved using the corrected sound source position information. Thus, also in the acoustic field controller 71, an acoustic field can be reproduced more appropriately.

Note that, although an annular microphone array or a spherical microphone array has been described above as an example of the microphone array 31, a straight microphone array may be used as the microphone array 31. Also in such a case, an acoustic field can be reproduced by processes similar to the processes described above.

In addition, the speaker array 48 is also not limited to an annular speaker array or a spherical speaker array, and may be any speaker array such as a straight speaker array.

Incidentally, the above-described series of processes may be performed by hardware or may be performed by software. When the series of processes are performed by software, a program forming the software is installed into a computer. Examples of the computer include a computer that is incorporated in dedicated hardware and a general-purpose computer that can perform various types of function by installing various types of program.

Figure 8:
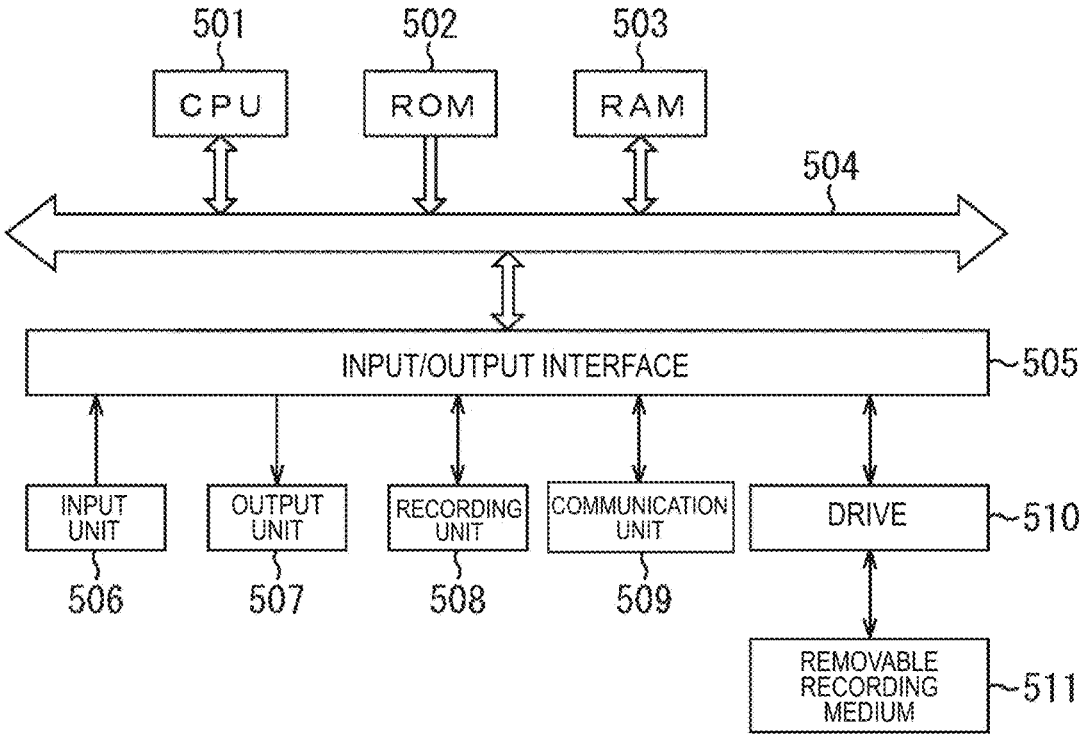
FIG. 8 is a diagram illustrating a configuration example of a computer.

FIG. 8 is a block diagram illustrating a configuration example of the hardware of a computer that performs the above-described series of processes with a program.

In the computer, a central processing unit (CPU) 501, read only memory (ROM) 502, and random access memory (RAM) 503 are mutually connected by a bus 504.

Further, an input/output interface 505 is connected to the bus 504. Connected to the input/output interface 505 are an input unit 506, an output unit 507, a recording unit 508, a communication unit 509, and a drive 510.

The input unit 506 includes a keyboard, a mouse, a microphone, an image sensor, and the like. The output unit 507 includes a display, a speaker, and the like. The recording unit 508 includes a hard disk, a non-volatile memory, and the like. The communication unit 509 includes a network interface, and the like. The drive 510 drives a removable recording medium 511 such as a magnetic disk, an optical disc, a magneto-optical disk, and a semiconductor memory.

In the computer configured as described above, the CPU 501 loads a program that is recorded, for example, in the recording unit 508 onto the RAM 503 via the input/output interface 505 and the bus 504, and executes the program, thereby performing the above-described series of processes.

For example, programs to be executed by the computer (CPU 501) can be recorded and provided in the removable recording medium 511, which is a packaged medium or the like. In addition, programs can be provided via a wired or wireless transmission medium such as a local area network, the Internet, and digital satellite broadcasting.

In the computer, by mounting the removable recording medium 511 onto the drive 510, programs can be installed into the recording unit 508 via the input/output interface 505. Programs can also be received by the communication unit 509 via a wired or wireless transmission medium, and installed into the recording unit 508. In addition, programs can be installed in advance into the ROM 502 or the recording unit 508.

Note that a program executed by the computer may be a program in which processes are chronologically carried out in a time series in the order described herein or may be a program in which processes are carried out in parallel or at necessary timing, such as when the processes are called.

In addition, embodiments of the present disclosure are not limited to the above-described embodiments, and various alterations may occur insofar as they are within the scope of the present disclosure.

For example, the present technology can adopt a configuration of cloud computing, in which a plurality of devices share a single function via a network and perform processes in collaboration.

Furthermore, each step in the above-described flowcharts can be executed by a single device or shared and executed by a plurality of devices.

In addition, when a single step includes a plurality of processes, the plurality of processes included in the single step can be executed by a single device or shared and executed by a plurality of devices.

The advantageous effects described herein are not limited, but merely examples. Any other advantageous effects may also be attained.

Additionally, the present technology may also be configured as below.

(1) A sound processing apparatus including:

a sound source position correction unit configured to correct sound source position information indicating a position of an object sound source, on a basis of a hearing position of a sound; and a reproduction area control unit configured to calculate a spatial frequency spectrum on a basis of an object sound source signal of a sound of the object sound source, the hearing position, and corrected sound source position information obtained by the correction, such that a reproduction area is adjusted in accordance with the hearing position provided inside a spherical or annular speaker array.

(2) The sound processing apparatus according to (1), in which the reproduction area control unit calculates the spatial frequency spectrum on a basis of the object sound source signal, a signal of a sound of a sound source that is different from the object sound source, the hearing position, and the corrected sound source position information.

(3) The sound processing apparatus according to (2), further including a sound source separation unit configured to separate a signal of a sound into the object sound source signal and a signal of a sound of a sound source that is different from the object sound source, by performing sound source separation.

(4) The sound processing apparatus according to any one of (1) to (3), in which the object sound source signal is a temporal signal or a spatial frequency spectrum of a sound.

(5) The sound processing apparatus according to any one of (1) to (4), in which the sound source position correction unit performs the correction such that a position of the object sound source moves by an amount corresponding to a movement amount of the hearing position.

(6) The sound processing apparatus according to (5), in which the reproduction area control unit calculates the spatial frequency spectrum in which the reproduction area is moved by the movement amount of the hearing position.

(7) The sound processing apparatus according to (6), in which the reproduction area control unit calculates the spatial frequency spectrum by moving the reproduction area on a spherical coordinate system.

(8) The sound processing apparatus according to any one of (1) to (7), further including:

a spatial frequency synthesis unit configured to calculate a temporal frequency spectrum by performing spatial frequency synthesis on the spatial frequency spectrum calculated by the reproduction area control unit; and a temporal frequency synthesis unit configured to calculate a drive signal of the speaker array by performing temporal frequency synthesis on the temporal frequency spectrum.

(9) A sound processing method including steps of:

correcting sound source position information indicating a position of an object sound source, on a basis of a hearing position of a sound; and calculating a spatial frequency spectrum on a basis of an object sound source signal of a sound of the object sound source, the hearing position, and corrected sound source position information obtained by the correction, such that a reproduction area is adjusted in accordance with the hearing position provided inside a spherical or annular speaker array.

(10) A program for causing a computer to execute a process inlcuding steps of:

correcting sound source position information indicating a position of an object sound source, on a basis of a hearing position of a sound; and calculating a spatial frequency spectrum on a basis of an object sound source signal of a sound of the object sound source, the hearing position, and corrected sound source position information obtained by the correction, such that a reproduction area is adjusted in accordance with the hearing position provided inside a spherical or annular speaker array.

REFERENCE SIGNS LIST

11 acoustic field controller
42 sound source separation unit
43 hearing position detection unit
44 sound source position correction unit
45 reproduction area control unit
46 spatial frequency synthesis unit
47 temporal frequency synthesis unit
48 speaker array

The invention claimed is:

1. A sound processing apparatus comprising:

a sound source position correction unit configured to correct sound source position information indicating a position of an object sound source, on a basis of a hearing position; and a reproduction area control unit configured to calculate a spatial frequency spectrum on a basis of an object sound source signal of the object sound source, the hearing position, and corrected sound source position information obtained by the correction, such that a reproduction area is adjusted in accordance with the hearing position provided inside a spherical or annular speaker array.

2. The sound processing apparatus according to claim 1, wherein the reproduction area control unit calculates the spatial frequency spectrum on a basis of the object sound source signal, a signal of a sound source that is different from the object sound source, the hearing position, and the corrected sound source position information.

3. The sound processing apparatus according to claim 2, further comprising a sound source separation unit configured to separate a signal of a sound into the object sound source signal and the signal of the sound source that is different from the object sound source, by performing sound source separation.

4. The sound processing apparatus according to claim 1, wherein the object sound source signal is a temporal signal or a spatial frequency spectrum.

5. The sound processing apparatus according to claim 1, wherein the sound source position correction unit performs the correction such that the position of the object sound source moves by an amount corresponding to a movement amount of the hearing position.

6. The sound processing apparatus according to claim 5, wherein the reproduction area control unit calculates the spatial frequency spectrum in which the reproduction area is moved by the movement amount of the hearing position.

7. The sound processing apparatus according to claim 6, wherein the reproduction area control unit calculates the spatial frequency spectrum by moving the reproduction area on a spherical coordinate system.

8. The sound processing apparatus according to claim 1, further comprising:

a spatial frequency synthesis unit configured to calculate a temporal frequency spectrum by performing spatial frequency synthesis on the spatial frequency spectrum calculated by the reproduction area control unit; and a temporal frequency synthesis unit configured to calculate a drive signal of the speaker array by performing temporal frequency synthesis on the temporal frequency spectrum.

9. A sound processing method comprising steps of:

correcting sound source position information indicating a position of an object sound source, on a basis of a hearing position; and calculating a spatial frequency spectrum on a basis of an object sound source signal of the object sound source, the hearing position, and corrected sound source position information obtained by the correction, such that a reproduction area is adjusted in accordance with the hearing position provided inside a spherical or annular speaker array.

10. A program for causing a computer to execute a process comprising steps of:

correcting sound source position information indicating a position of an object sound source, on a basis of a hearing position; and calculating a spatial frequency spectrum on a basis of an object sound source signal of the object sound source, the hearing position, and corrected sound source position information obtained by the correction, such that a reproduction area is adjusted in accordance with the hearing position provided inside a spherical or annular speaker array.

* * * * *